US006006487A

United States Patent [19]

Leek

[11] Patent Number: 6,006,487

[45] Date of Patent: Dec. 28, 1999

[54] LOADBEARING WALL HOLDOWN

[75] Inventor: William F. Leek, Carmel, Calif.

[73] Assignee: Simpson Strong-Tie Co., Inc., Pleasanton, Calif.

[21] Appl. No.: 09/005,307

[22] Filed: Jan. 9, 1998

[51] Int. Cl.[6] ..... E04B 1/38

[52] U.S. Cl. ..... 52/698; 52/293.1; 52/295; 52/702; 52/714; 403/190; 403/232.1

[58] Field of Search ..... 52/293.1, 293.3, 52/295, 296, 698, 714, 745.21, 712, 702; 238/120; 403/232.1, 190, 277

[56] References Cited

U.S. PATENT DOCUMENTS

| | | | |
|---|---|---|---|
| D. 224,083 | 7/1972 | Gilb . | |
| 1,704,593 | 3/1929 | Downing | 238/120 X |
| 1,806,607 | 5/1931 | Brown | 238/120 X |
| 2,169,474 | 8/1939 | Pederson . | |
| 2,321,221 | 6/1943 | Linehan . | |
| 4,192,118 | 5/1980 | Gilb . | |
| 4,321,776 | 3/1982 | Delight . | |
| 4,665,672 | 5/1987 | Commins | 52/295 |
| 4,744,192 | 5/1988 | Commins . | |
| 4,825,621 | 5/1989 | Jensen . | |
| 5,092,097 | 3/1992 | Young | 52/293.1 X |
| 5,249,404 | 10/1993 | Leek et al. | 52/293.1 X |
| 5,375,384 | 12/1994 | Wolfson | 52/295 |
| 5,467,570 | 11/1995 | Leek . | |
| 5,813,181 | 9/1998 | Ashton et al. . | |

OTHER PUBLICATIONS

Simpson Strong–Tie Co. Inc.—Brochure: What's New for 1997?

Simpson Strong–Tie Company, Inc. catalog, 1966, p. 13.

Simpson Strong–Tie Company, Inc. catalog, 1967, p. 13.

Simpson Strong–Tie Company, Inc. catalog, 1968, p. 9.

Simpson Strong–Tie Company, Inc. catalog, 1970, p. 16.

Simpson Strong–Tie Company, Inc. catalog, 1979, p. 5.

Simpson Strong–Tie Company, Inc. catalog, 1983, p. 7.

Connectors for Wood Construction, Simpson Strong–Tie Co. catalog, 1986, p. 7.

Connectors for Wood Construction, Simpson Strong–Tie Co. catalog, 1990, p. 9.

Simpson Strong–Tie Co., catalog, 1993, p. 13.

*Primary Examiner*—Carl D. Friedman

*Assistant Examiner*—Winnie Yip

*Attorney, Agent, or Firm*—James R. Cypher; Charles R. Cypher

[57] ABSTRACT

The present invention is a channel-shaped connector for connecting a first building structural member to a second building structural member in conjunction with fasteners and an anchor member to resist forces on buildings imposed by earthquakes, hurricanes, tornadoes and other similar cataclysmic forces. A connector constructed in accordance with the present invention consists of a back member formed to interface with the fasteners for attaching the back member to the first building structural member, a first side member connected to the back member, a second side member connected to the back member, and first and second anchor receiving members. Both the first and second anchor receiving members extend laterally between the first and second side members, and both the first and second anchor receiving members are connected to the first and second side members. The first and second anchor receiving members are disposed so that a space exists between the first and second anchor receiving members for receiving the anchor member therethrough for attaching the connector to the second building structural member.

15 Claims, 9 Drawing Sheets

LOADBEARING WALL HOLDOWN

BACKGROUND

This invention relates to a connector for anchoring a first building structural member to a second building structural member. The connector works in conjunction with a separate anchor member that is received by or is attached to the second building structural member and with fasteners for attaching the connector to the first building structural member.

Earthquakes, hurricanes, tornadoes, and floods impose forces on a building that can cause structural failure. To counteract these forces, it has become common practice to strengthen or add ties between the structural members of a building in areas where such cataclysmic forces may be imposed. For example: framed walls can be attached to the foundation rather than merely rest on it; connections between the framed walls of each floor can be strengthened; and joists can be connected to both their headers and the walls that support the headers. One of the most common connectors designed for this application is called a holdown by the inventor. Holdowns are commonly used to anchor framed walls to the foundation.

Early holdowns were constructed from two or more separate pieces of metal welded together. These holdowns had to be painted to prevent rusting. They were heavy and costly to produce.

State of the art holdowns are made from galvanized sheet metal formed on progressive die machines that require no welding or painting. See U.S. Pat. No. 4,665,672, granted May 19, 1987, to Commins, Gilb and Littleton; U.S. Pat. No. 5,092,097 granted Mar. 3, 1992, to Young; and U.S. Pat. No. 5,249,404, granted Oct. 5, 1993, to Leek and Commins. These advancements have reduced the cost of making holdowns while increasing their ability to withstand tension forces. However, recent severe earthquakes in San Francisco, Los Angeles, and Kobe, Japan, demonstrate that holdowns capable of being mass produced and installed inexpensively should be made even stronger for many connections.

Generally, holdown connectors that work in conjunction with a separate anchor member and attach to only one face of the first building structural member—generally a vertically disposed stud—work in a common fashion. The anchor member attaches at the seat of the connector. This seat is connected to a back member. The back member attaches to the first building structural member. Most holdown connectors have one or more side members to increase the strength of the connector or to connect the seat member to the back member.

The holdown connector of the present invention works in a similar fashion to most of the prior art holdowns, such that it is amenable to standard installation practices. The holdown connector of the present invention improves on the prior art by accommodating variations in the position of the anchor member parallel to the face of the first building structural member to which the holdown connector attaches. The holdown connector of the present invention also withstands high tension loads while being economical to produce.

SUMMARY OF THE INVENTION

The object of the present invention is to provide a connector that better withstands tension forces than the prior art while still being economical to produce and install.

A further object of the present invention is to provide a connector that accommodates variations in the position of the anchor member parallel to the face of the first building structural member to which the holdown connector attaches. This object is achieved by forming the connector with a wide space for receiving the anchor member.

The object of making a holdown that is economical to produce is achieved by utilizing a design that can be formed from galvanized sheet metal on standard die press machinery, eliminating costly secondary operations such as painting and welding.

The object of making a holdown that is easy to install is achieved by utilizing a design that is amenable to current building practices.

These and other objects of the present invention will become apparent, with reference to the drawings, the description of the preferred embodiment and the claims.

DESCRIPTION OF THE PREFERRED EMBODIMENT

Figure 2:
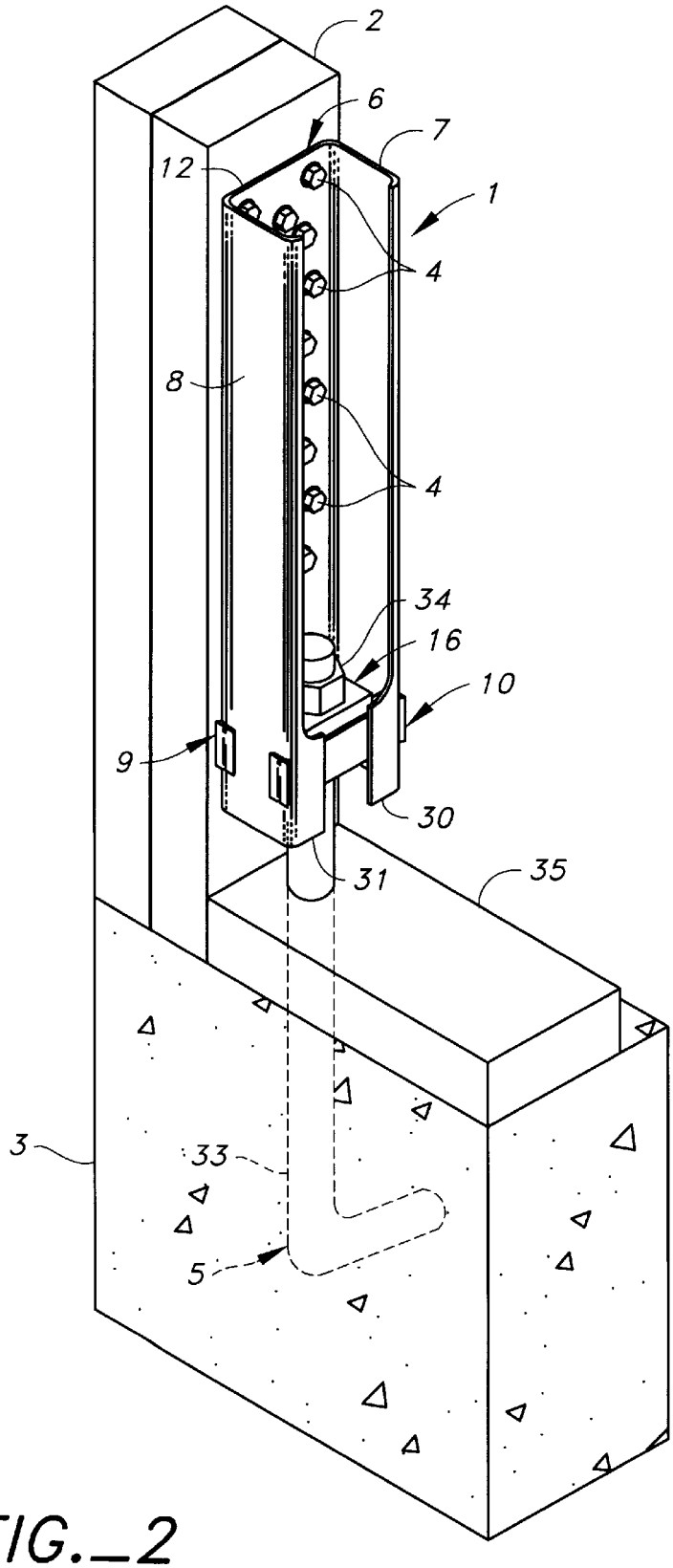
FIG. 2 is a perspective view of a connector constructed in accordance with the present invention, making the connection between the first building structural member and the second building structural member in conjunction with threaded fasteners and an anchor member.
Figure 4:
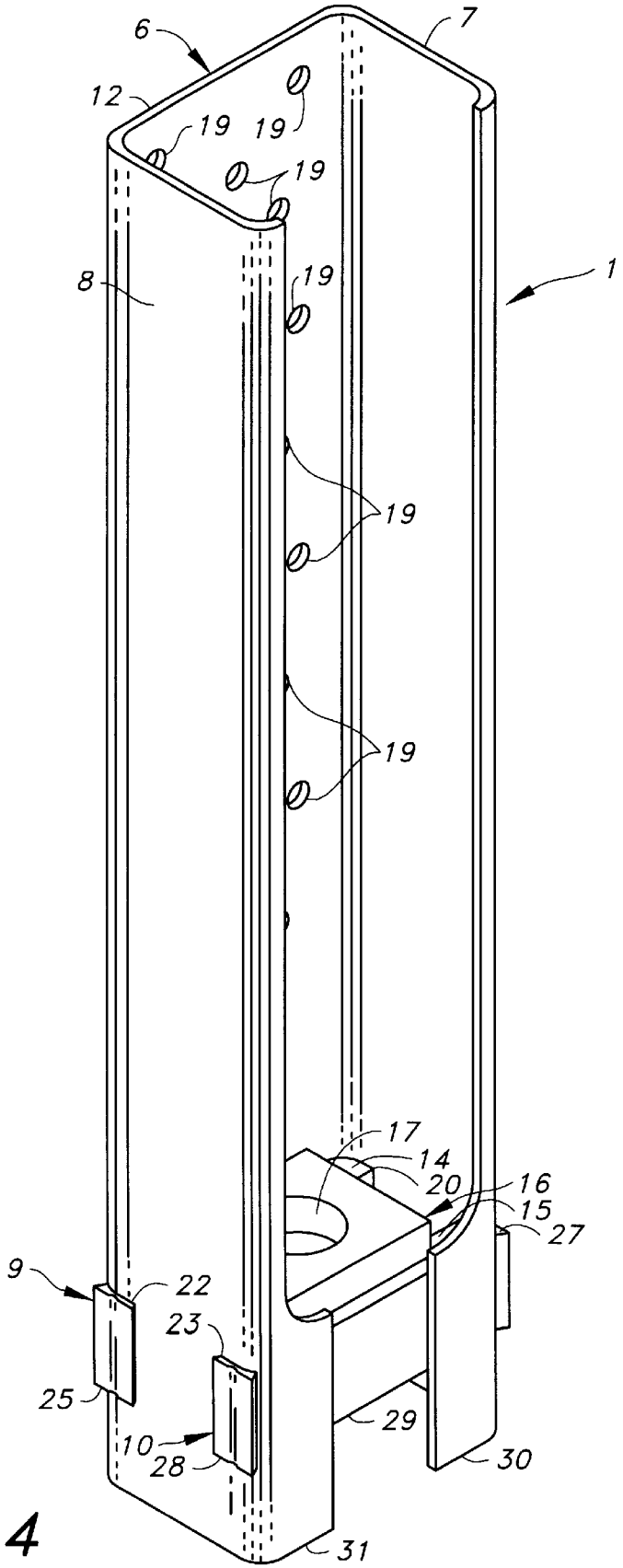
FIG. 4 is a perspective view of a connector constructed in accordance with the present invention.
Figure 6:
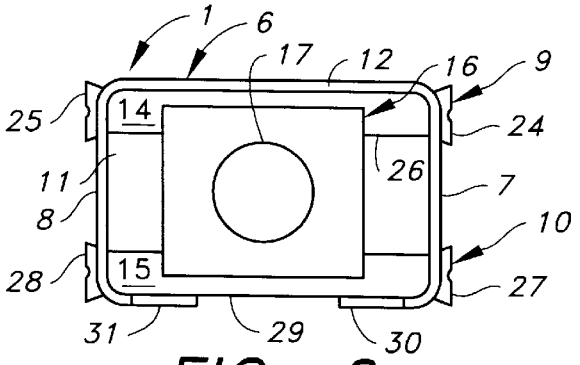
FIG. 6 is a top plan view of the connector of FIG. 4.

As seen in FIGS. 4 and 2, a connector 1 for tying a first building structural member 2 to a second building structural member 3 in conjunction with fasteners 4 and an anchor member 5, constructed in accordance with the present invention, consists of a back member 6 formed to interface with the fasteners 4 for attaching the back member 6 to the first building structural member 2, a first side member 7 connected to the back member 6, a second side member 8 connected to the back member 6, and first and second anchor receiving members 9 and 10. Both the first and second anchor receiving members 9 and 10 extend laterally between the first and second side members 7 and 8, and both the first and second anchor receiving members 9 and 10 are connected to the first and second side members 7 and 8, the first and second anchor receiving members 9 and 10 are disposed so that a space 11 exists between the first and second anchor receiving members 9 and 10 for receiving the anchor member 5 therethrough for attaching the connector 1 to the second building structural member 3. As is shown in FIG. 6, space 11 is bounded by the first and second anchor receiving members 9 and 10 and the first and second side members 7 and 8. This creates the maximum room possible for receiving the anchor member 5.

Preferably, the back member 6 has a top edge 12 and a bottom edge 13, and the first and second anchor receiving members 9 and 10 are formed with aligned support faces 14 and 15 oriented toward the top edge 12 of the back member 6.

As shown in FIG. 6, in the preferred embodiment, a washer member 16 is disposed on the aligned support faces 14 and 15 of the first and second anchor receiving members 9 and 10 such that it spans the space 11 between the first and second anchor receiving members 9 and 10. The washer member 16 is formed with an opening 17 for receiving the anchor member 5 therethrough, for attaching the connector 1 to the second building structural member 3.

Preferably, the back member 6 of the connector 1 is formed with openings 18 and 19 for receiving the fasteners 4.

Figure 5:
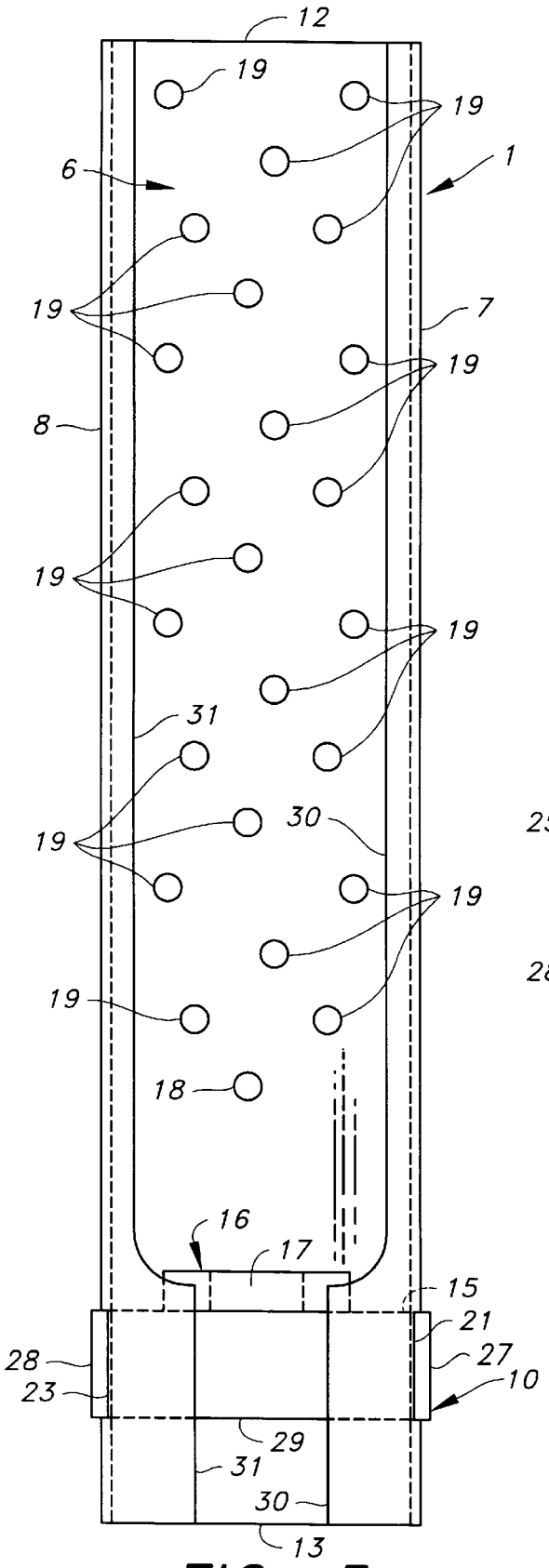
FIG. 5 is a front elevation view of the connector of FIG. 4.

In the preferred embodiment, the first and second anchor receiving members 9 and 10 are formed separate from the back and side members 6, 7 and 8 and later mechanically connected to the side members 7 and 8. As is best shown in FIGS. 4 and 5, the first side member 7 is formed with a first opening 20 which receives the first anchor receiving member 9 and a second opening 21 which receives the second anchor receiving member 10. The second side member 8 is formed with a first opening 22 which receives the first anchor receiving member 9 and a second opening 23 which receives the second anchor receiving member 10.

As is shown in FIG. 6, the first anchor receiving member 9 is formed with first and second ends 24 and 25 and a body portion 26, and the second anchor receiving member 10 is also formed with first and second ends 27 and 28 and a body portion 29. To lock the first and second anchor receiving members in place after they have been inserted into the first and second side members 7 and 8 the first ends 24 and 27 and the second ends 25 and 28 of the first and second anchor receiving members 9 and 10 are widened beyond the dimensions of the body portions 26 and 29 of the first and second anchor receiving members 9 and 10 and beyond the dimensions of the first openings 20 and 22 and the second openings 21 and 23 in the first and second side members 7 and 8 that receive the first and second anchor receiving members 9 and 10. This is accomplished during manufacture by swaging the first and second ends 24 and 25 of the first anchor receiving member 9 and the first and second ends 27 and 28 of the second anchor receiving member 10.

Also, as is shown in FIG. 4, in the preferred embodiment, the first and second side members 7 and 8 are substantially rectangular in shape. Further, a first flange 30 is connected to the first side member 7 opposite the back member 6; and a second flange 31 is connected to the second side member 8 opposite the back member 6.

Preferably, the first and second flanges 30 and 31 extend the length of the first and second side members 7 and 8 and extend toward each other. As is also shown in FIG. 4, the first and second side flanges 30 and 31 are of variable width, extending closer to each other where the first and second anchor receiving members 9 and 10 are connected to the first and second side members 7 and 8.

Figure 7:
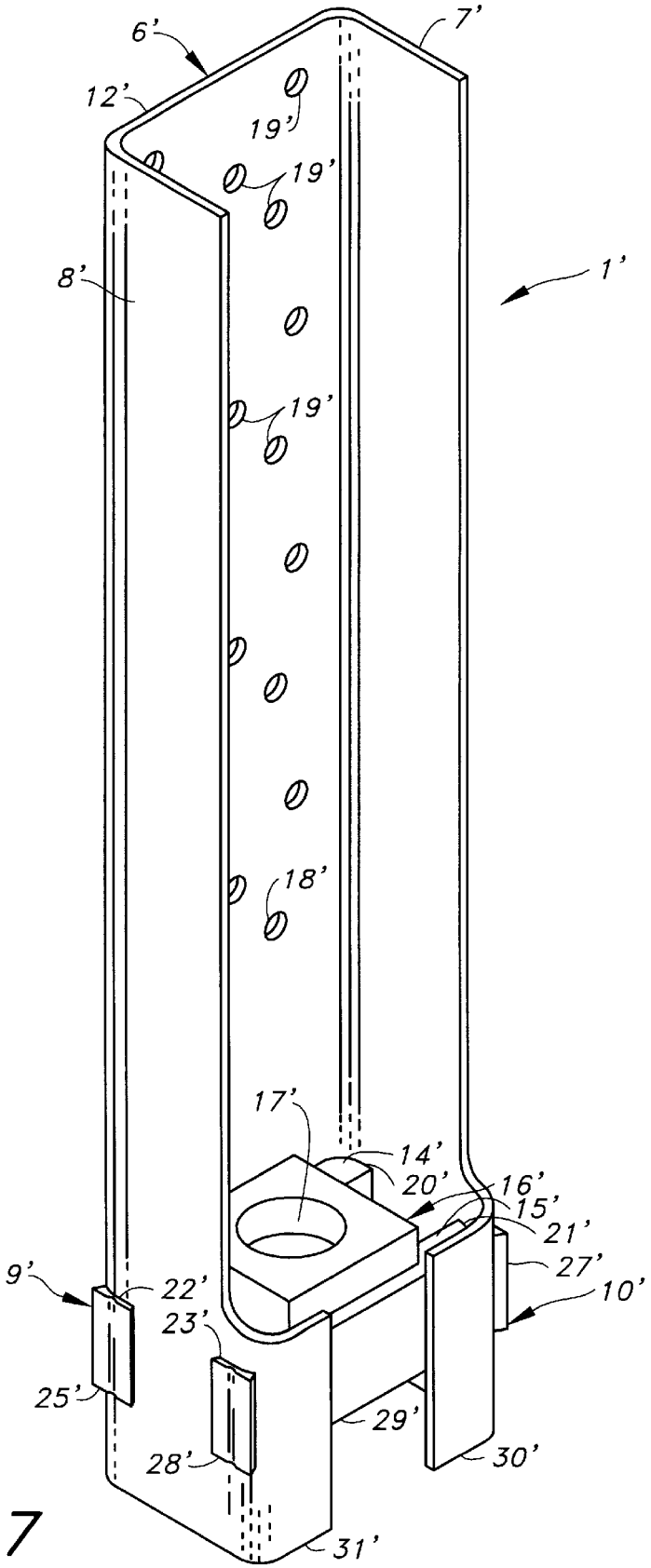
FIG. 7 is a perspective view of a connector constructed in accordance with the present invention.
Figure 8:
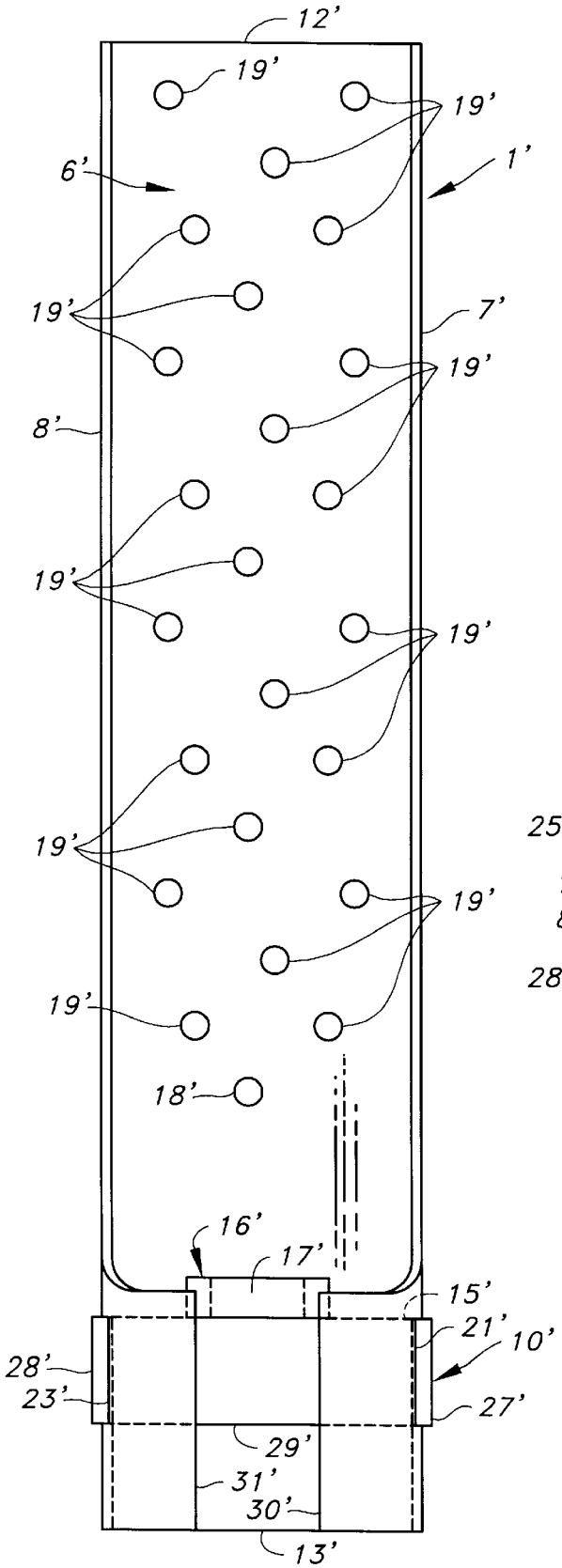
FIG. 8 is a front elevation view of the connector of FIG. 7.
Figure 9:
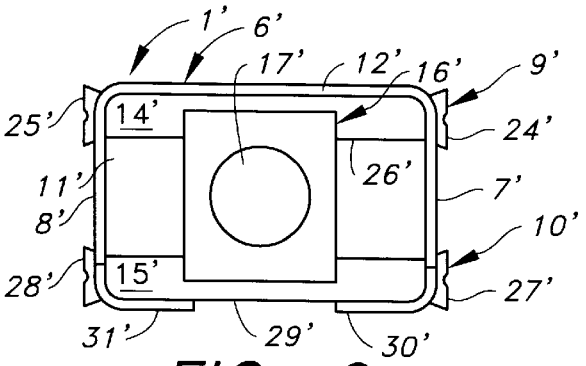
FIG. 9 is a top plan view of the connector of FIG. 7.

As is shown in FIGS. 7, 8 and 9, an alternate embodiment of the present invention can be made wherein the first and second flanges 30' and 31' do not extend the length of the first and second side members 7' and 8'. This is done to better accommodate the insertion of the fasteners 4 into the first building structural member 2 through openings 18' and 19' in the back member 6'. The alternate embodiment of the connector 1' shown in FIGS. 7, 8 and 9 is formed with the same elements and works in a similar fashion as the preferred embodiment; thus further description is not necessary. It has all the same elements as the preferred embodiment. Like elements are designated by like numbers followed by single primes.

Figure 10:
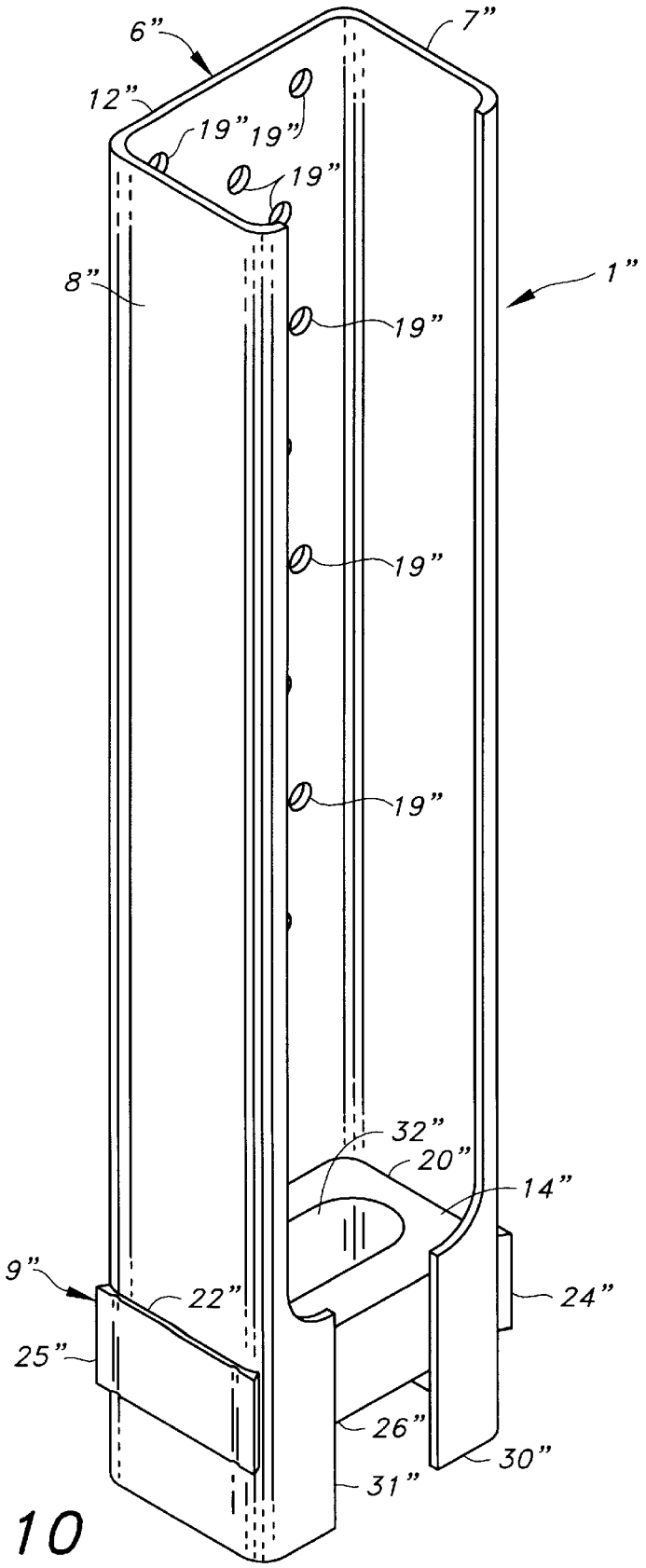
FIG. 10 is a perspective view of a connector constructed in accordance with the present invention.
Figure 11:
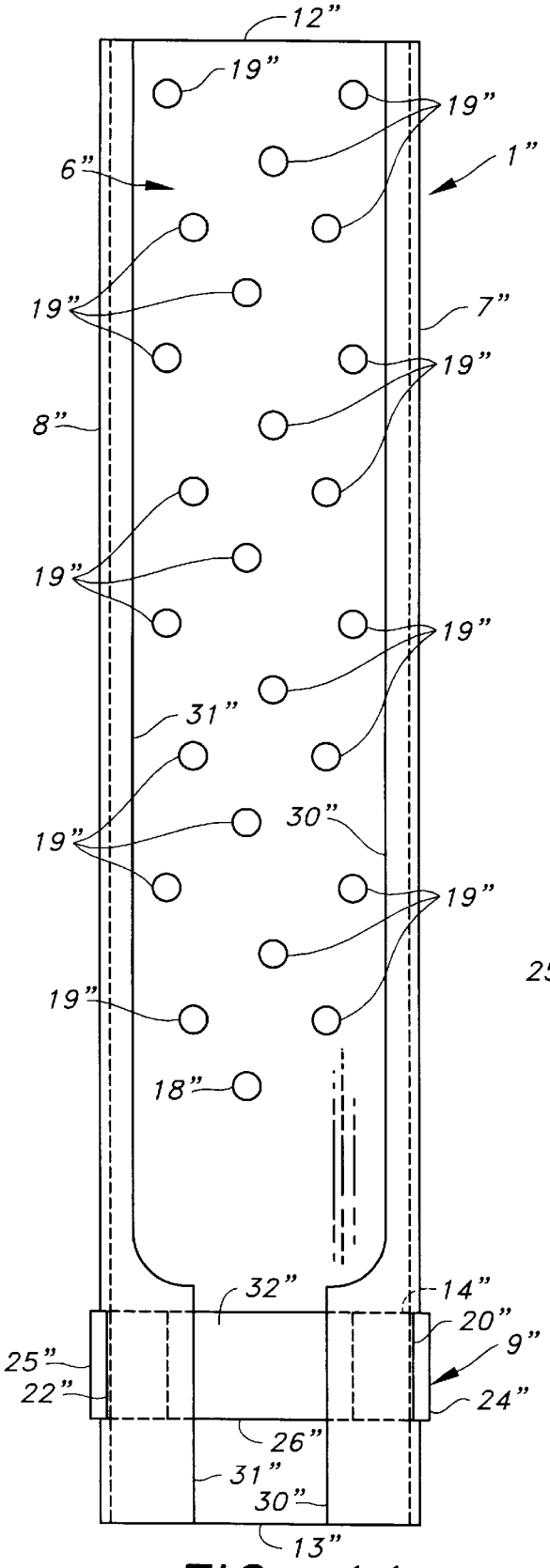
FIG. 11 is a front elevation view of the connector of FIG. 10.
Figure 12:
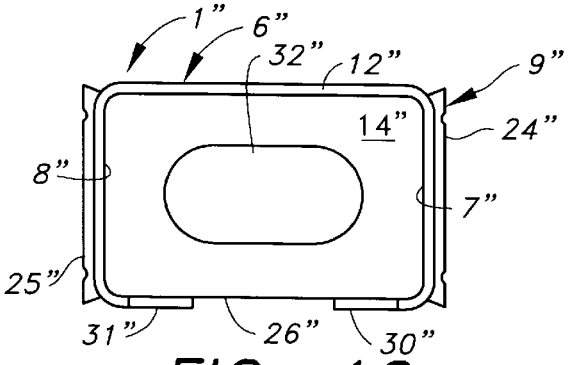
FIG. 12 is a top plan view of the connector of FIG. 10.

Another alternate embodiment of the present invention is shown in FIGS. 10, 11, and 12. In this alternate embodiment, the connector 1" for tying a first building structural member 2 to a second building structural member 3 in conjunction with fasteners 4 and an anchor member 5, consists of a back member 6" formed to interface with the fasteners 4 for attaching the back member 6" to the first building structural member 2, a first side member 7" connected to the back member 6", the first side member 7" being formed with a first opening 20", a second side member 8" connected to the back member 6", the second side member 8" also being formed with a first opening 22", and a first anchor receiving member 9" formed with a support face 14" for achieving mechanical interlock with the anchor member and an aperture 32" for receiving the anchor member 5 for attaching the connector 1" to the second building structural member 3, the first anchor receiving member 9" being inserted into first openings 20" and 22" in the first and second side members 7 and 8.

Like the preferred embodiment, the first anchor receiving member 9" of the connector 1" has first and second ends 24" and 25" and a body portion 26". To lock the first anchor receiving member 9" in place the first and second ends 24" and 25" of the first anchor receiving member 9" are widened beyond the dimensions of the body portion 26" of the first anchor receiving member 9" and widened beyond the dimensions of the first openings 20" and 22" in the first and second side members 7" and 8" after the first anchor receiving member 9" has been inserted into the first openings 20" and 22".

Aside from the differences noted above, the alternate embodiment of the connector 1" shown in FIGS. 10, 11 and 12 is formed with similar elements and works in a similar fashion as the preferred embodiment; thus further description is not necessary. Like elements are designated by like numbers followed by double primes. The new element—an aperture 32" in the first anchor receiving member 9" for receiving the anchor member 5—is also designated with a double prime.

Referring to FIG. 5, in the preferred embodiment the first and second side members 7 and 8 of the connector 1 are formed generally parallel to each other.

Referring to FIG. 2, the anchor member 5 can consist of an anchor bolt 33 and a holding member 34 attached thereto. When the second building structural member 3 is a concrete foundation, the bottom portion of the anchor bolt 33 is embedded in the second building structural member 3, as shown in FIG. 2. The top end of the anchor bolt 33 can be formed with a threaded portion to which the holding member 34, generally a threaded nut, can releasably attach, completing the anchor member 5.

Figure 3:
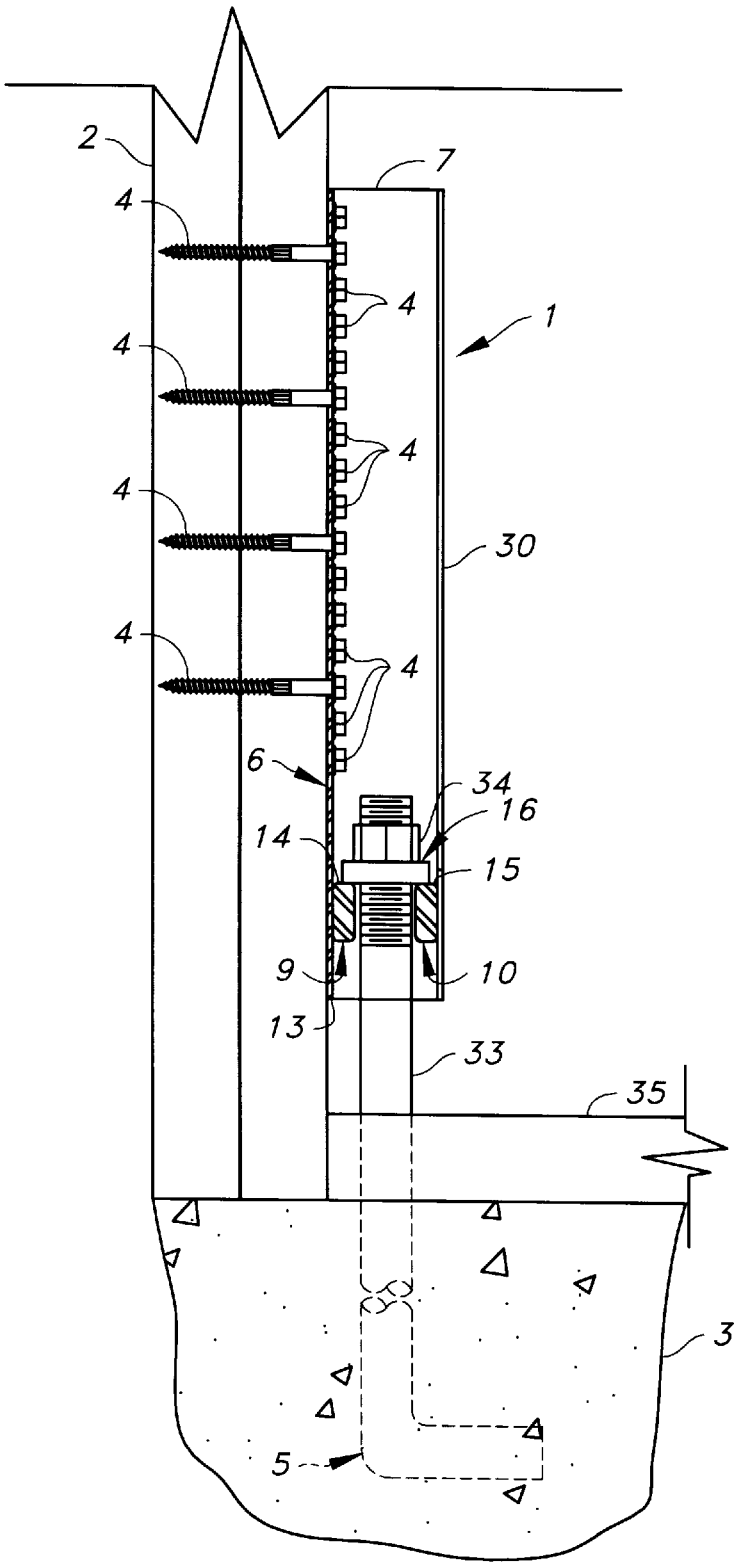
FIG. 3 is a cross-sectional side view of the connector of FIG. 3.

Referring to FIG. 3, when the first building structural member 2 is made of wood, the fasteners 4 are preferably wood screws with cutting points. The fasteners can also be nails, threaded bolts with nuts, lag screws, or steel screws to name a few variations. The use of self-drilling wood screws as fasteners 4 eliminates the need for the added step of drilling a hole for a regular bolt that has no drilling point. Also, self-drilling wood screws need not pass all the way through the first building structural member 2, so access to the back side of the first building structural member 2 is not necessary. Self-drilling wood screws create a stronger connection than nails, and self-drilling wood screws can be installed almost as quickly as nails if an electric-powered or pneumatic driver is used.

Referring to FIG. 5, in the preferred embodiment, the lowest opening 18 in the back member 6 is spaced from the bottom edge 13 of the back member 6 by a selected distance. This distance is dependent on the fasteners 4 used with the connector 1 and the form and composition of the first building structural member 2 to which the back member 6 connects. Splitting of wooden structural members is a problem if fasteners 4 that pierce the first building structural member 2 are placed too close to the end of the first building structural member 2.

When the first building structural member 2 is made of steel the connector 1 can be welded to the first building structural member 2, thus the back member 6 need not be formed with openings 18 and 19 and the fasteners 4 can be welds.

The back member 6, the first and second side members 7 and 8 and the first and second flange members 30 and 31 of the preferred embodiment are formed from pre-galvanized sheet metal. The first and second anchor receiving members 9 and 10 are preferably formed from pre-galvanized metal. The preferred form requires no secondary production operations after it is formed such as welding or painting. This reduces manufacturing costs.

The preferred embodiment is formed in the following manner. A blank, consisting of the back member 6, the first and second side members 7 and 8 and the first and second flange members 30 and 31, is cut from the pre-galvanized sheet metal. The openings 18 and 19 in the back member 6, the first and second openings 20 and 21 in the first side member 7, and the first and second openings 22 and 23 in the second side member 8 are formed by cutting out portions from the blank. The blank is then formed into the generally channel shape shown in FIG. 4, by bending the first and second side members 7 and 8 up from the back member 6, and by bending the first flange 30 up from the first side member 7, and by bending the second flange 31 up from the second side member 8. The first anchor receiving member 9 is then inserted into the first openings 20 and 22 in the first and second side members 7 and 8, and the second anchor receiving member 10 is inserted into the second openings 21 and 23 in the first and second side members 7 and 8. Then the first and second ends 24 and 25 of the first anchor receiving member are swaged to lock the first anchor receiving member in place, and the first and second ends 27 and 28 of the second anchor receiving member 10 are swaged to lock the second anchor receiving member 10 in place.

Figure 1:
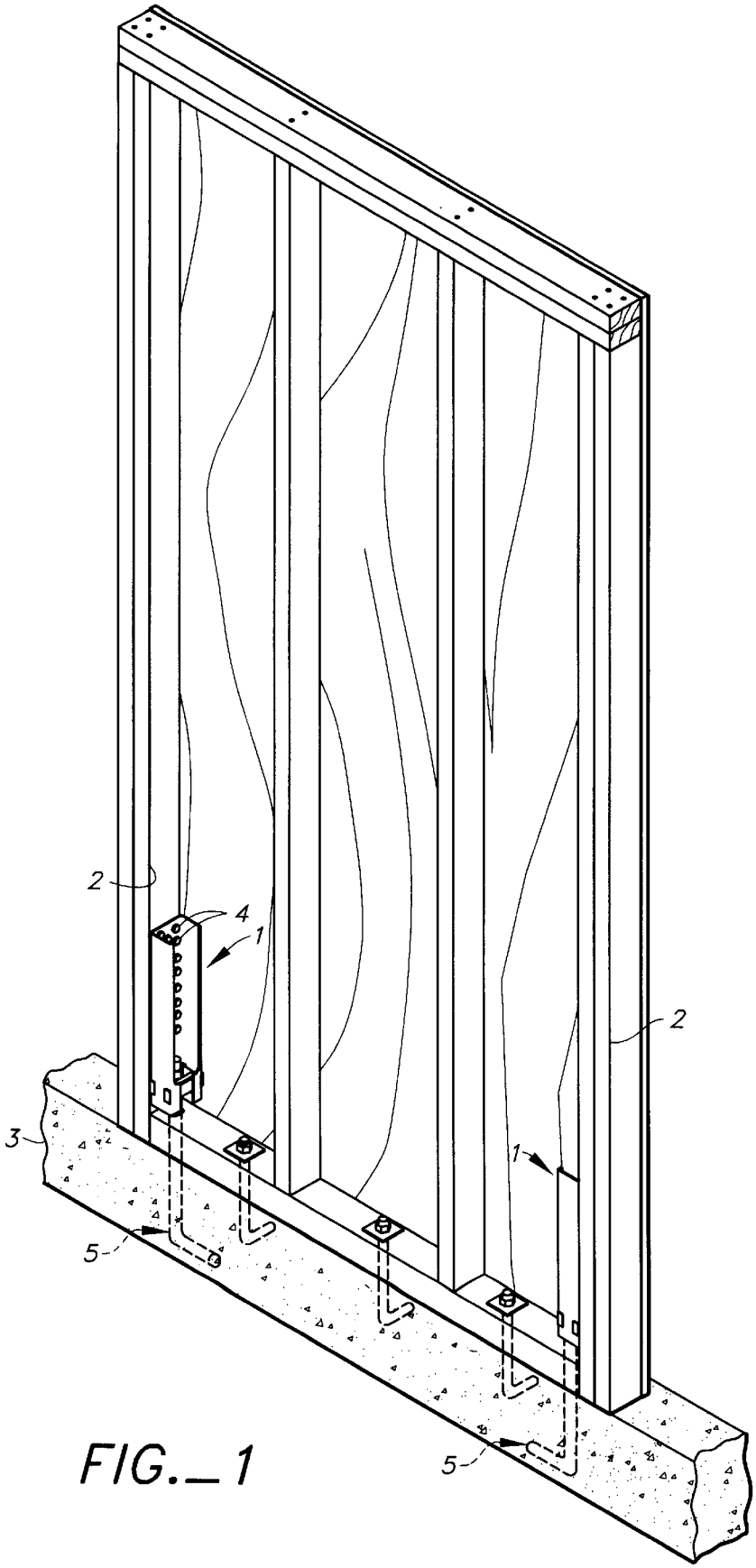
FIG. 1 is a perspective view of a shearwall. The end studs of the shearwall are anchored by the holdown connector of the present invention.

FIGS. 1 and 2 show a typical use of the preferred embodiment. In FIGS. 1 and 2 the first building structural member 2 is a vertical stud of a framed wall and the second building structural member 3 is a concrete foundation. The present invention may also be used to transfer tension loads between floors of a framed structure, or to tie joists to masonry or concrete walls, to name but a few applications.

Installation of the connector 1 of the preferred embodiment to form a foundation-to-wooden-stud connection is illustrated by FIGS. 1 and 2. First, an anchor bolt 33 having a threaded top portion is embedded in the second building structural member 3. This can be done by placing the bottom portion of the anchor bolt 33 in the wet concrete or by forming the second building structural member 3 with the top portion of the anchor bolt 33 protruding from it. An opening is then drilled in the transfer member 35 and the anchor bolt 33 is inserted therethrough with the threaded portion of the anchor bolt 33 exposed above the top of the transfer member 35.

The threaded portion of the anchor bolt 33 is inserted between the first and second anchor receiving members 9 and 10, such that it protrudes above the first and second anchor receiving members 9 and 10. A washer member 16 having an opening 17 is inserted over the top portion of the anchor bolt 33 so that it rests on the aligned support faces 14 and 15 of the first and second anchor receiving member 9 and 10. The back member 6 of the connector 1 is set against the side of the first building structural member 2. Fasteners 4 are driven into the first building structural member 2 through the openings 18 and 19 in the back member 6, forming a tight fit between the back member 6 of the connector 1 and the first building structural member 2. A holding member 34 is then placed on the threaded portion of the anchor bolt 33 and tightened down so that it bears upon the washer member 16 and the washer member bears upon the aligned support faces 14 and 15 of the first and second anchor receiving members 9 and 10, completing the anchor member 4, and the connection.

Testing of the Present Invention

In order to characterize the improvements associated with the present invention, shearwalls were constructed and anchored with connectors built according to the present invention and compared to shearwalls anchored with a currently-available holdown sold by Simpson Strong-Tie Co. called the PHD8. The PHD8 is the subject of U.S. patent application Ser. No. 08/729,056, and is described therein. The shearwalls were similar in appearance to the wall shown in FIG. 1, except that they sat on and were connected to the base of a test frame rather than a foundation. The shearwalls consisted of a 4'×8' structural panel supported on its long edges by first and second chords and on its short edges by top and bottom struts. Intermediate studs were also spaced between the first and second chords to further strengthen the shearwall.

The shearwalls were tested in Brea, Calif. at the Simpson Strong-Tie Co. Laboratory on a machine designed to simulate the cyclic (reversing) lateral forces that would be imposed on a shearwall or vertical lateral-force-resisting system during an earthquake.

The test can be used to measure the strength of the shearwall and the stiffness of the shearwall. Stiffness of a shearwall is measured in terms of the force that is required to displace the top of the wall a given distance. The strength of a shearwall can be described in these same terms as well as by how much force is required to cause a failure of the shearwall, that is the point when the shearwall no longer provides any meaningful resistance to lateral forces. Test results are reported in table 1 for two different shearwalls in terms of the force required to displace the top of the wall 0.5" under cyclic loading conditions (Load at 0.5"), the force required to displace the top of the wall 1.0" (Load at 1.0"), and the load at which failure of the wall occurs (Maximum Load). The test show that a shearwall anchored with holdowns of the present invention performs better than a shearwall anchored by the PHD8.

The tests were conducted according to a protocol developed by the Joint Technical Coordinating Committee on Masonry Research (TCCMAR) in 1987. See Porter, M. L., *Sequential Phased Displacement (SPD) procedure for TCCMAR Testing*, Proceedings of the Third Meeting of the Joint Technical Coordinating Committee on Masonry Research, U.S.—Japan Coordinated Earthquake Research Program, Tomamu, Japan.

The TCCMAR procedure hinges on the concept of the First Major Event (FME), which is defined as the first significant limit state which occurs during the test. The FME occurs when the load capacity of the wall, upon recycling of load to the same wall displacement increment, first drops noticeably from the original load and displacement. FME for all tests was assumed to occur when an 8 foot high shearwall can be displaced 0.8 inches at its top.

The TCCMAR procedure consists of applying cycles of fully-reversing displacement to the shearwall at various increments of the wall's assumed FME. The wall is both pushed and pulled an equal distance in each cycle.

In the first phase, three cycles of fully-reversing displacement are applied to the top of the shearwall at 25% of FME. The first phase continues by then applying three cycles of fully-reversing displacement at 50% of FME. Then, three cycles of fully-reversing displacement are applied at 75% of FME. Then, the fully-reversing displacement is increased for one cycle to 100% of FME. This is the maximum displacement for this first phase. Next, "decay" cycles of displacement for one cycle each at 75%, 50%, and 25% of the phase-maximum are applied in that order respectively. Then, three stabilizing cycles of displacement at the phase-maximum (100% of FME) are applied to the top of the shearwall. These phase-ending cycles stabilize the load-displacement response of the shearwall, prior to the next phase of testing.

In the second phase, which follows immediately according to the test frequency, one phase-maximum cycle of fully-reversing displacement is applied at 125% of FME. Next, "decay" cycles of displacement for one cycle each at 75%, 50%, and 25% of the maximum for that phase are applied in that order respectively. Then, three stabilizing cycles of displacement equal to the phase-maximum for the phase (125% of FME for the second phase) are applied to the shearwall.

In the third phase, one phase-maximum cycle of fully-reversing displacement at 150% of FME is applied to the shearwall. Next, "decay" cycles of displacement for one cycle each at 75%, 50% and 25% of the phase-maximum for the phase are applied. Then, three stabilizing cycles of displacement equal to the phase-maximum (150% of FME for the third phase) are applied to the top of the shearwall.

Successive phases are continued in a like manner as the second and third phases at increased increments. The incremental cyclic load-displacement phases are continued at phase-maximums of 175%, 200%, 250%, 300%, 350% and 400% of FME, or until the wall exhibits excessive displacement, or until the wall displacement exceeds the capacity of the test equipment, which in this case was ±3.0 inches. In both trials, the lateral load capacity of the shearwall had greatly diminished by the time the shearwall was displaced 3.0 inches.

Racking shear loads were applied to the test specimens through an actuator located at the top of the wall. The actuator was placed so that the actuator did not interfere with any movement of the structural panel that formed the webbing of the shearwall. The actuator that caused deflection at the top of the shearwall was computer controlled. Actuator loads were applied to the wall at a frequency of one cycle per second.

The shearwalls were attached to the base of the test frame with ⅝" diameter foundation bolts, passing through the bottom strut, spaced approximately 12" on center, and 12" from the ends of the shearwall.

The vertically-disposed first and second chords of the shearwalls—the first building structural members—were attached to the test frame. Test F945 used the holdown of the present invention. Test F910 used the PHD8 holdown. In both tests the anchor members were ⅞" inch anchor bolts that passed through the bottom strut fitted with a nut. The PHD8 holdown and the holdown of the present invention were both attached to the first and second chords of the shearwalls by means of 24¼"×3" Simpson Strong Drive Screws.

Generally, lumber moisture content for the components of the shearwall at the time of the tests was approximately 20 to 25%.

The top struts were doubled 2×4s connected with nails. The top struts for each shear wall were 48" long. In addition to the top and bottom struts and the first and second chords, two intermediate 2×4 studs, spaced 16" on center from each other and the first and second chords, were added and end-nailed to the top and bottom struts with nails according to currently accepted building practices.

In both tests, the first and second chords were approximately 93" tall. This means the chords sat directly on the test frame. Setting the chords on the test frame eliminates failure of the shearwall due to crushing of the bottom strut by the chords, and greatly improves the performance of the shearwall. This particular design of using long chords that bypass the bottom strut is especially effective where the shearwall sits on the relatively non-compressible building foundation. In both tests the first and second chords were made from individual wood members glued together to form a laminate.

Oriented Strand Board structural panels were used for the structural panel or shear-resisting element in the tests. Both tests were conducted with one 4'×8' structural panel applied to the framing members with the face grain or strength axis disposed vertically.

The structural panels were fastened to the top and bottom struts and the first and second chords by steel 10d common nails that were 3" long. All nails were driven into the framing members to a depth of at least 11 times their shank diameter to comply with the Uniform Building Code. All nails were driven so that the head of the nail sat flush against boundary edging members attached to the structural panel. The nails were generally spaced 2" on center around the periphery of the structural panel. The structural panel was also attached to the intermediate studs with 10d×3" long common nails. Both tests used "u" shaped boundary edging members to strengthen the connection between the framing members and the structural panel. The "u" shaped boundary edging members were fitted on the edges of the structural panel with the legs of the "u" shaped member on either side of the structural panel. The nails pierced the legs of the "u" shaped boundary edging member as they passed through the structural panel into the framing members.

TABLE 1

| Test: | F910 | F945 |
|---|---|---|
| Date: | 7/8/97 | 10/6/97 |
| Wall size: | 4' × 8' | 4' × 8' |
| Nailing schedule: | 2" o.c. | 2" o.c. along top and sides; 3 rows staggered at 4" |

TABLE 1-continued

| Test: | F910 | F945 |
|---|---|---|
| | | o.c. along bottom |
| Nails: | 10d × 3" nails | 10d × 3" common nails |
| Structural panel: | 15/32" S-1 Potlatch OSB | 15/32" S-1 Potlatch OSB |
| Chord design: | long | long |
| Chords: | Wilamette B4 Glu-Lam SYP | Wilamette B4 Glu-Lam SYP |
| Bottom strut: | 1 - Wolmerized 2 × 4 | 1 - Douglas Fir 3 × 4 |
| Boundary edging present: | "u" shaped 20 gauge edging | "u" shaped 20 gauge edging |
| Holdown: | PHD8 | New holdown |
| Foundation Bolts: | 3⅝" bolts | 3⅝" bolts |
| Load at 0.5" | 5,500 | 4,900 |
| Load at 1.0" | 8,650 | 9,000 |
| Maximum Load | 11,500 | 13,150 |

The invention is not limited to the specific form shown, but includes all forms within the definitions of the following claims.

I claim:

1. A connector for tying a first building structural member to a second building structural member in conjunction with fasteners and an anchor member, said connector comprising:

a. a back member formed to interface with said fasteners for attaching said back member to said first building structural member;

b. a first side member connected to said back member;

c. a second side member connected to said back member; and d. first and second anchor receiving members, both of said first and second anchor receiving members extending laterally between said first and second side members, and both of said first and second anchor receiving members being interlocked and connected to said first and second side members such that said first and second anchor receiving members cannot rise or descend without affecting said first and second side members, said first and second side members providing support for said first and second anchor receiving members, and said first and second anchor receiving members being disposed so that a space exists between said first and second anchor receiving members for receiving said anchor member therethrough for attaching said connector to said second building structural member.

2. The connector of claim 1, wherein:

a. said back member has a top edge and a bottom edge; and b. said first and second anchor receiving members are formed with aligned support faces.

3. The connector of claim 2, further comprising:

a washer member disposed on said aligned support faces of said first and second anchor receiving members, spanning said space between said first and second anchor receiving members, said washer member formed with an opening for receiving said anchor member therethrough for attaching said connector to said second building structural member.

4. The connector of claim 1, wherein:

said back member is formed with openings for receiving said fasteners.

5. The connector of claim 1, wherein:

a. said first side member is formed with a first opening which receives said first anchor receiving member and a second opening which receives said second anchor receiving member; and b. said second side member is formed with a first opening which receives said first anchor receiving member and a second opening which receives said second anchor receiving member.

6. The connector of claim 5, wherein:

a. said first anchor receiving member has first and second ends and a body portion;

b. said second anchor receiving member has first and second ends and a body portion; and wherein c. said first ends and said second ends of said first and second anchor receiving members are wider than said body portions of said first and second anchor receiving members and wider than said first openings and said second openings in said first and second side members that receive said first and second anchor receiving members such that said first and second anchor receiving members are locked in place.

7. The connector of claim 1, wherein:

said first and second side members are substantially rectangular in shape.

8. The connector of claim 1, further comprising:

a. a first flange connected to said first side member opposite said back member; and b. a second flange connected to said second side member opposite said back member.

9. The connector of claim 8, wherein:

a. said first and second flanges extend the length of said first and second side members and extend toward each other; and wherein b. said first and second side flanges are of variable width, extending closer to each other where said first and second anchor receiving members are connected to said first and second side members.

10. A connector for tying a first building structural member to a second building structural member in conjunction with fasteners and an anchor member, said connector comprising:

a. a back member formed to interface with said fasteners for attaching said back member to said first building structural member;

b. a first side member connected to said back member and formed with a first opening;

c. a second side member connected to said back member and formed with a first opening;

d. a first anchor receiving member formed with a support face for achieving mechanical interlock with said anchor member and an aperture for receiving said anchor member for attaching said connector to said second building structural member, said first anchor receiving member being inserted into said first openings in said first and second side members, said side members supporting said first anchor receiving member; and wherein e. said first anchor receiving member has first and second ends and a body portion; and wherein f. said first and second ends of said first anchor receiving member are wider than said body portion of said first anchor receiving member and wider than said first openings in said first and second side members that receive said first anchor receiving member such that said first anchor receiving member is locked in place.

11. The connector of claim 10, wherein:

said back member is formed with openings for receiving said fasteners.

12. The connector of claim 10, wherein:

said first and second side members are substantially rectangular in shape.

13. The connector of claim 10, further comprising:

a. a first flange connected to said first side member opposite said back member; and b. a second flange connected to said second side member opposite said back member.

14. The connector of claim 13, wherein:

a. said first and second flanges extend the length of said first and second side members and extend toward each other; and wherein b. said first and second side flanges are of variable width, extending closer to each other.

15. A connector for tying a first building structural member to a second building structural member in conjunction with fasteners and an anchor member, said connector comprising:

a. a back member formed to interface with said fasteners for attaching said back member to said first building structural member;

b. a first rectangular side member connected to said back member;

c. a second rectangular side member connected to said back member; and d. a first anchor receiving member formed with a support face for achieving mechanical interlock with said anchor member and with an aperture for receiving said anchor member for attaching said connector to said second building structural member, said first anchor receiving member extending laterally between said first and second side members, and said first anchor receiving member being connected to said first and second side members;

e. a first flange connected to said first side member opposite said back member;

f. a second flange connected to said second side member opposite said back member; and wherein g. said first and second flanges extend the length of said first and second side members and extend toward each other; and wherein h. said first and second side flanges are of variable width, extending closer to each other.

* * * * *